United States Patent [19]

Kinneir

[11] Patent Number: 4,623,276

[45] Date of Patent: Nov. 18, 1986

[54] PORTABLE LECTERNS

[75] Inventor: Ross Kinneir, Bristol, England

[73] Assignee: Bensons International Systems, Limited, Gloucestershire, England

[21] Appl. No.: 743,248

[22] Filed: Jun. 11, 1985

[30] Foreign Application Priority Data

Jul. 21, 1984 [GB] United Kingdom ..... 8418654

[51] Int. Cl.[4] ..... B42F 13/00; B42F 13/40; B42D 3/00; A47B 23/00

[52] U.S. Cl. ..... 402/80 R; 402/76; 281/31; 281/33; D6/419

[58] Field of Search ..... 402/24, 76, 80 R; 281/33; 248/441.1, 445, 447, 450, 456, 459; D6/419, 420

[56] References Cited

U.S. PATENT DOCUMENTS

| | | | |
|---|---|---|---|
| 2,776,150 | 1/1957 | Ericson | 281/33 |
| 2,971,733 | 2/1961 | Silverman | 281/33 |
| 3,410,516 | 11/1968 | Criswell | 248/459 |
| 3,870,223 | 3/1975 | Wyant | 281/31 |
| 3,936,202 | 2/1976 | Brajitul | 402/24 |
| 4,015,863 | 4/1977 | Holum | 281/33 |
| 4,240,761 | 12/1980 | Jacobson | 402/76 |
| 4,377,271 | 3/1983 | Smith | 281/33 |
| 4,420,270 | 12/1983 | Rossello | 281/33 |

FOREIGN PATENT DOCUMENTS

| | | |
|---|---|---|
| 20166 | 12/1980 | European Pat. Off. . |
| 568521 | 9/1944 | United Kingdom . |
| 872982 | 7/1961 | United Kingdom . |

*Primary Examiner*—Paul A. Bell
*Assistant Examiner*—Paul M. Heyrana, Sr.
*Attorney, Agent, or Firm*—Pennie & Edmonds

[57] ABSTRACT

A portable lectern comprising means for releasably a plurality of sheet members of paper or the like retaining and a base member configured and dimensioned for standing in a stable manner on a relatively flat surface. The base member comprises a generally planar section and means for supporting the sheet member retaining means in a predetermined position for viewing the sheet members to facilitate reading or lecturing therefrom. The supporting means are located on at least one side of one edge of the generally planar section. The base member is configured and dimensioned to be selectively removably combinable with the sheet member retaining means to facilitate portability of same for transport, storage, or the like.

22 Claims, 13 Drawing Figures

PORTABLE LECTERNS

TECHNICAL FIELD

The invention relates to lecterns or stands for supporting books in a generally or somewhat inclined position for ease of reading, and more particularly to such lecterns for use on a supporting surface, such as desktop or work surface

BACKGROUND ART

Lecterns normally comprise a generally upright or somewhat inclined plate, support, or other structure which define a surface against which papers or a book can rest at the required angle, the plate, support or other structure having a substantial height commensurate with that of the size of papers or book intended to be used or displayed thereon. Additionally, such lecterns normally include a leg or other structure disposed rearwardly of the inclined plate to engage a supporting surface at a position spaced from the plate so as to provide vertical stability for the lectern. Thus, such known types of lectern are of substantial size in not only both horizontal dimensions, but also in the vertical dimension.

In contrast, the present invention provides an improved lectern which is especially suitable for use with, or for combination with, a book of the loose leaf type, such as a ring binder, although various embodiments of the invention as hereinafter described may also be used with other types of books and paper holding items.

SUMMARY OF THE INVENTION

The invention relates to a portable lectern comprising means for releasably retaining a plurality of sheet members of paper or the like and a base member configured and dimensioned for standing in a stable manner on a relatively flat surface. The base member includes a generally planar section and means for supporting the sheet member retaining means in a predetermined position for viewing the sheet members to facilitate reading or lecturing therefrom. The supporting means extend along a portion of one side of the generally planar section. The base member is configured and dimensioned to be selectively removeably combinable with the sheet member retaining means to facilitate portability of same for transport, storage, or the like.

For transport or storage as a compact unit, the dimensions of base member are equal to or less than the dimensions of the sheet member retaining means so that the base member may be assembled upon or within the sheet member retaining means.

Preferably, the support means comprises a channel portion for contacting a marginal portion of the sheet member retaining means to maintain it at a predetermined slightly inclined or generally vertical orientation to facilitate viewing. This channel portion comprises a first side portion that is generally perpendicular to said generally planar section, a generally flat base portion extending thereupon for contact with a support surface, and a second side connected to the base portion for engagement with the sheet member retaining means when the retaining means is positioned on the channel portion first side. The dimensions and relative configurations of the first and second sides of the channel member are such as to support the retaining means at the predetermined viewing position.

In one embodiment, the channel portion extends substantially completely along the side of the generally planar section. Alternately, the channel portion can be configured in the form of a slot which corresponds to the predetermined angle of the sheet member retaining means.

Also, the channel portion may be formed by folding the base member upon itself. In this arrangement, the base member includes a lip portion on a first side and a substantially perpendicular wall member on the opposite side. The dimensions and relative configurations of the lip portion, wall member, and first and second sides of the base member, after folding, are such as to support the retaining means at the predetermined viewing position.

In the lectern of the invention, the most advantageous sheet member retaining means is a clipboard or loose leaf ring binder.

The invention also relates to a portable lectern comprising a binder having front and rear cover members connected by a spine portion. At least one of these members includes means for releasably retaining a plurality of sheet members such as paper or the like between the cover members. The lectern also includes a base member configured and dimensioned for free standing in a stable manner on a support surface. The base member comprises at least one generally planar section and channel means for contacting a marginal portion of the binder to maintain it at a predetermined slightly inclined or generally vertical orientation to facilitate viewing of the sheet members for reading or lecturing therefrom.

The channel means is located on one side of the generally planar section, while the base member is configured and dimensioned to be selectively removably combinable with the binder to facilitate portability of same for transport, storage or the like.

In this embodiment, the dimensions of the base member are equal to or less than the dimensions of the binder so that the base member may be assembled within the binder for transport or storage as a compact unit. Also, at least one of the binder or base member comprises pocket means for holding articles such as floppy disks, loose sheet members, cassette tapes, or other information storage means. Preferably, the retaining means comprises at least two ring means.

It is also possible for the base member to include a number of elongated slots or grooves which correspond to the number of ring means of the retaining means for nestling engagement of the base member therewith.

The channel means may be formed as a rigid, integral extension of the planar section of the base member, and can include slots or apertures adapted to receptively accommodate the ring means when the base member is assembled within the binder. Also, each of the remaining three sides of the planar section of the base member may include a wall member extending generally perpendicular thereto so as to form a tray for articles such as sheet members, information storage means, or the like.

An alternate embodiment of the invention relates to a compact portable lectern comprising front and rear cover members each connected on one side by a spine portion and means for releasably retaining a plurality of sheet members such as paper or the like. The retaining means is located on at least one of the front and rear cover members or the spine portion. A portion of each cover member is foldable along a predetermined axis to selected relative angular positions for supporting the remaining portions of the front and rear cover members and the spine portion at a predetermined angle with respect to a support surface for viewing the sheet members to facilitate reading or lecturing therefrom.

The predetermined foldable axis of the front and rear cover members preferably extends in a substantially diagonal direction across the cover members. Also, each non-connected side of the front and rear cover members further comprise a wall member extending generally perpendicular thereto such that the front and rear cover members each form a tray for holding the plurality of sheet members when the lectern is in a compact, portable position.

According to the invention, another lectern comprises a base part which is adapted to rest in a stable manner on a supporting surface and is formed or provided at one and with a channel to receive the lower edge of the cover of a book and support said cover at a desired angle in a generally upright or somewhat inclined position, the channel being of a depth in which is much less than the transverse dimensions of the base, so that the lectern as a whole is of relatively shallow form.

Another lectern in accordance with the invention is particularly suitable for use with a binder of the loose leaf type, in that due to its shallow form it may be placed inside the cover of the loose leaf binder when not in use. This aspect of the invention relates to a lectern which includes a loose leaf binder comprising a cover affording front and rear cover plates and a spine, at least one of which carries means for releasably securing sheet members of paper or the like between the cover plates, and a base member of transverse dimensions not greater than those of the cover plates having a channel partially formed or provided at one end to receive the lower edge of the binder cover and support the cover at a predetermined angle in a generally upright or somewhat inclined position. The channel of the base member has a depth which is much less than the transverse dimensions of the cover so that the base member as a whole is of relatively shallow form so that when not in use the base member may be assembled in the binder between the cover plates.

In a preferred arrangement, the channel is so shaped and dimensioned as to be capable of being accommodated in a space available within the binder between the cover and any leaves of paper held by the means whereby such leaves are releasably secured. Where such means comprise a ring binder mechanism, the channel may be formed or provided with apertures adapted to accommodate the rings thereof. On the other hand, the channel could be designed to be accommodated at the outer edge of the binder, remote from the spine, in a space available between leaves of the size for which the binder is intended and the outer edges of the cover plates.

The invention also relates to a base member for converting books, binders, clipboards, or other sheet retaining means into a lectern for viewing, reading or lecturing therefrom. The base member comprises a generally planar portion and means for supporting the book, binder, clipboard, or sheet member retaining means in a predetermined position for viewing, reading, or lecturing therefrom. The supporting means extend along a portion of one side of the generally planar portion. Also, the base member is configured and dimensioned for standing in a stable manner on a relatively flat surface.

BRIEF DESCRIPTION OF THE DRAWINGS

These and other features of the invention will now be described by way of example with reference to various embodiments of the invention as illustrated in the accompanying drawings wherein.

DETAILED DESCRIPTION OF THE PREFERRED EMBODIMENTS

Figure 1:
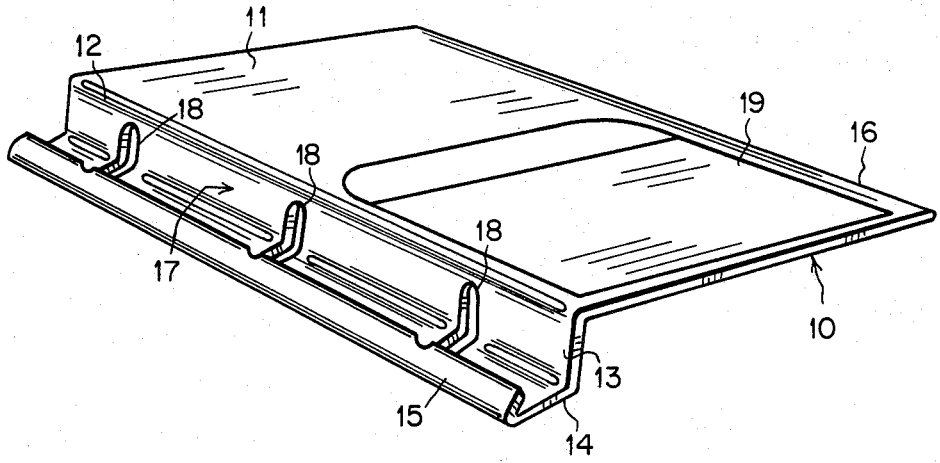
FIG. 1 is a perspective view of a lectern base in accordance with the invention.
Figure 2:
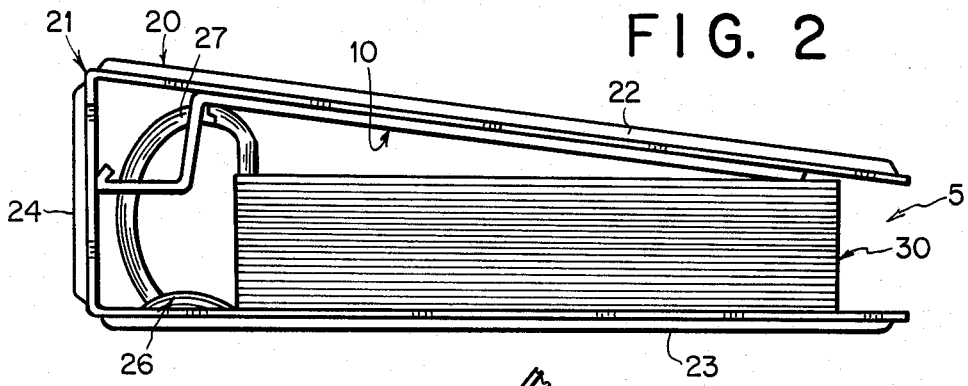
FIG. 2 illustrates the lectern base of FIG. 1 in association with a ring binder, in a position of storage.
Figure 3:
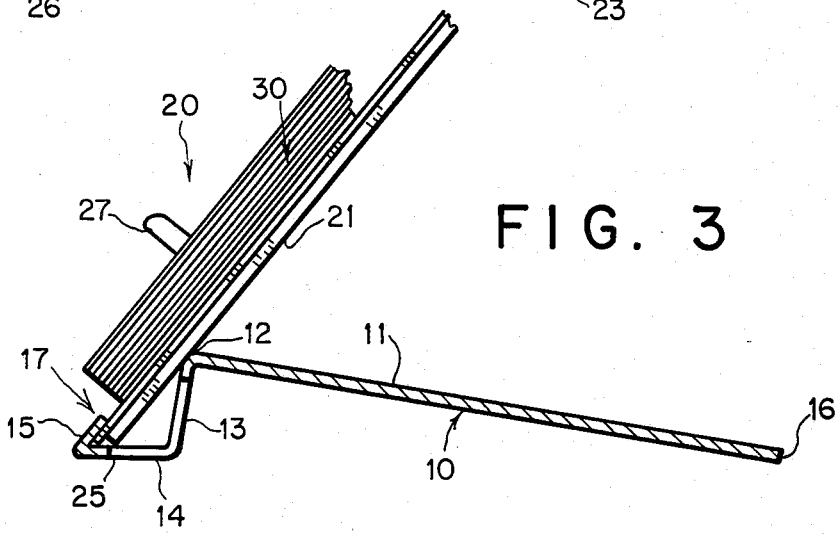
FIG. 3 illustrates the lectern in a position of use, with the base supporting the ring binder.

Referring initially to FIGS. 1–3, there is illustrated a two-piece portable lectern 5 according to the invention. This portable lectern 5 includes a base member 10 formed of a metal, such as steel or aluminum, or a suitable plastic material. The main portion 11 of this base member is a flat plate dimensioned to correspond to the page size of the second part of this lectern, which, for this embodiment, is loose leaf binder 20. For example, the main portion 11 may have dimensions substantially equivalent to an $8\frac{1}{2}\times 11''$ page size of the paper 30 in the binder 20.

At the forward edge 12, the base member 10 turns downwardly to provide a wall 13, and outwardly to afford a flange 14, and finally upwardly to afford a lip 15.

As can be seen most clearly in FIG. 2, the rearward edge 16 of the plate is preferably disposed in substantially the same plane as the flange 14 so that the lectern may rest on a horizontal supporting surface in a stable manner.

The wall 13, flange 14 and lip 15 collectively define a channel portion 17 which is adopted to receive the lower marginal edge of the cover 21 of the binder 20. As can be seen from FIG. 3, the arrangement is such that the lower edge 25 of the cover plates 22, 23 of the binder 20 rests within the corner defined between the lip 15 and flange 14, while the outer faces at the cover 21 engage the forward edge 12 of the lectern at a short distance above the lower edges 25, and thereby hold the binder 20 at the desired angle.

Referring now to FIG. 2, it will be seen that the lectern 5 is designed so as to be capable of being accommodated within the ring binder 20 for compactness during transportation of the lectern 5. The latter comprises a cover 21 affording a front cover plate 22, rear cover plate 23 and a spine 24 to which the cover plates are hingedly connected. A ring binder mechanism 26 is carried by the rear cover plate 23 at a position adjacent to the spine 24 in known manner, and includes a plurality of rings 27 which may be opened and closed in known manner so as to receive leaves of punched paper shown collectively at 30. As can be seen, the main portion 11 of the base member 10 can rest on the paper 30 with the channel portion 17 accommodated in the space between the inner edges of the leaves and the spine 24. For this purpose, the wall 13 and flange 14 in combination are formed with slots 18 at positions which register with the rings 27 of the binder mechanism. The free edge of the lip 15 may also be notched at corresponding positions where, as in the illustrated embodiment, the lip is inwardly inclined.

The slots 18 are so dimensioned relate to the rings 27 as to enable the lectern simply to be slipped without requiring the rings to be opened. However, it will be appreciated that in some cases it may be appropriate to arrange the dimensions of the channel portion 17 such that the lip 15 is accommodated within the interior of the rings 27 so that the rings have to be opened to enable the base member 10 to be removed and assembled with the binder 20, and then closed to retain the member positively in assembled relation therein.

Where the binder is intended for use as a computer software manual, the main portion 11 of the plate 10 may be formed or provided with a pocket 19 adopted to receive and protect articles such as floppy discs, cassette tapes or the like.

Figure 4:
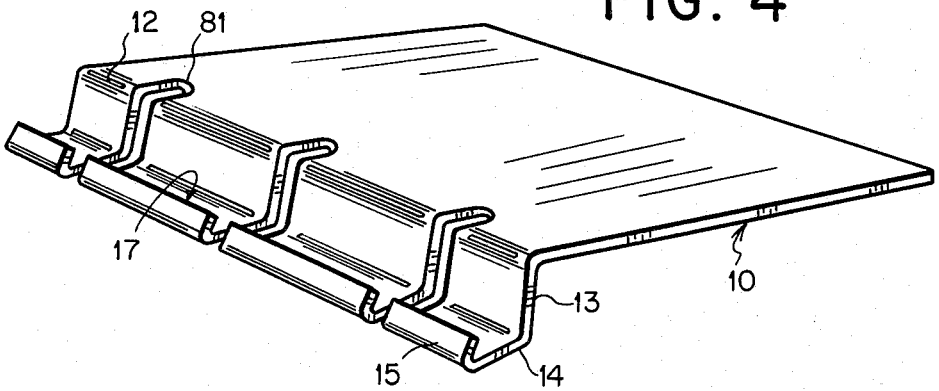
FIG. 4 illustrates a modification of the lectern base of FIG. 1.
Figure 5:
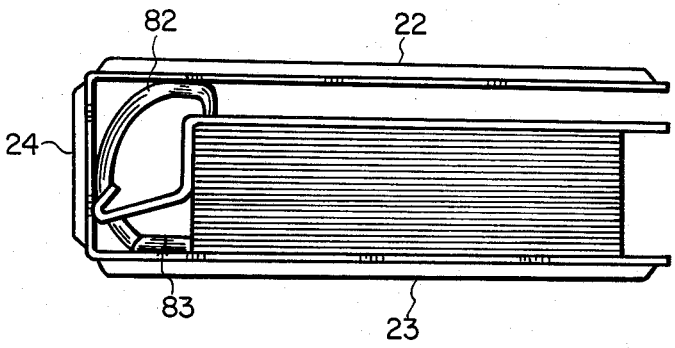
FIG. 5 illustrates the lectern base of FIG. 4 in association with a ring binder of the kind having a binder mechanism mounted on the rear cover plate.
Figure 6:
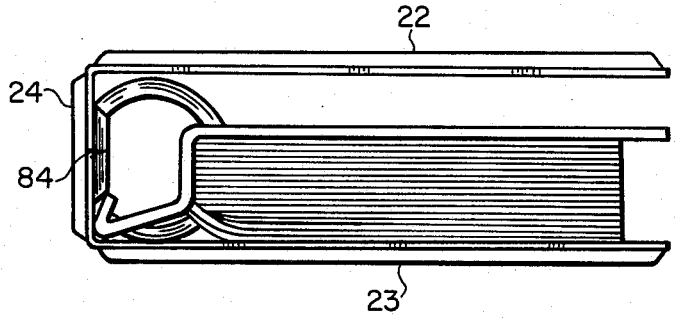
FIG. 6 illustrates a lectern base of the type illustrated in FIG. 4 in association with a ring binder of the type having the binder mechanism mounted on the spine.

FIG. 4 illustrates a modification of the lectern of FIGS. 1-3. It is of generally similar design and, where appropriate, the same reference numerals are employed. However, the slots 81 are of open ended form and extend through the lip 15 as well as the flange 14 and wall 13, and additionally they extend past the forward edge 12 of the base member 10. This modification enables the lectern to be used with a binder, as shown in FIG. 5 having somewhat smaller, generally D-shaped rings 82 in a binder mechanism 83, or with a binder as illustrated in FIG. 6 wherein the ring binder mechanism 84 is mounted on the spine 24 instead of the rear cover plate 23.

Figure 7:
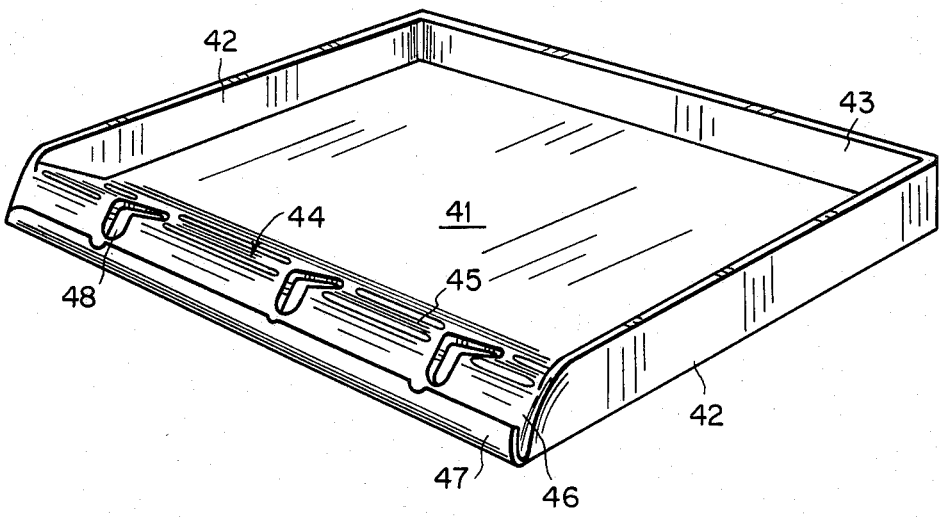
FIG. 7 illustrates a second embodiment of a lectern base in accordance with the invention.
Figure 8:
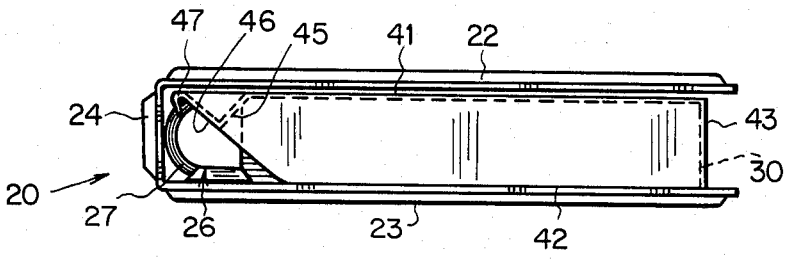
FIG. 8 illustrates the lectern base of FIG. 3 in association with a ring binder.

Referring now to FIG. 7, there is illustrated a further embodiment of lectern which may be formed of a molded plastic material, or fabricated from metal. In this case, the lectern includes a generally flat base 41 with upstanding side walls 42 and end wall 43 so as to define a shallow tray which, in use, encloses and protects the pages 30 mounted in a ring binder 20 when the lectern is assembled therewith as illustrates in FIG. 8. At the forward edge of the tray, there is a ridge 44 of generally triangular shape, which may be solid in cross-section, or may comprise, as illustrated, an inclined rear wall 45 and an inclined front wall 46. At its lower edge the latter includes an upturned lip 47 which with the front wall 46 defines a channel whereby the lower edge of the cover 21 of the binder 20 may be received and supported in a manner similar to that illustrated in FIG. 2, except that in this case the rear face of the cover 21 may engage the wall 46 over its entire height. Slots 48 are formed in the ridge 44 to accommodate the rings 27 of the binder mechanism 26.

Figure 9:
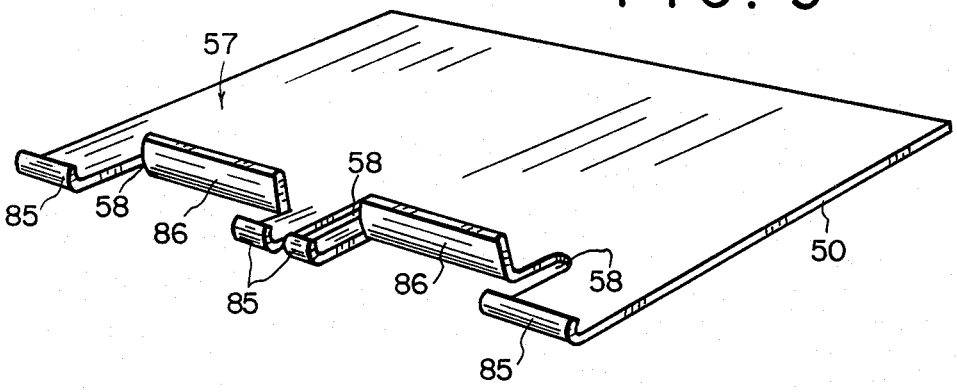
FIG. 9 illustrates a further embodiment of a lectern base in accordance with the invention.

The further embodiment illustrated in FIG. 9 comprises a generally flat plate 50 formed with slots 58 extending from one edge. Portions 85 of the plate at that edge are turned upwardly and inwardly to afford an interrupted lip similar to the lip 15 of the FIG. 1 embodiment. Further portions 86 of the plate are also turned upwardly to form an interrupted wall generally similar to the wall 13 of the embodiment of FIG. 1. Thus, the portions 85 and 86, together with adjacent parts of the plate 50 collectively define a channel 57 in which the lower edge of the cover of the binder 20 may be received in substantially the same manner as illustrated in FIG. 3, except that the plate 50 rests flat on the supporting surface.

Figure 10:
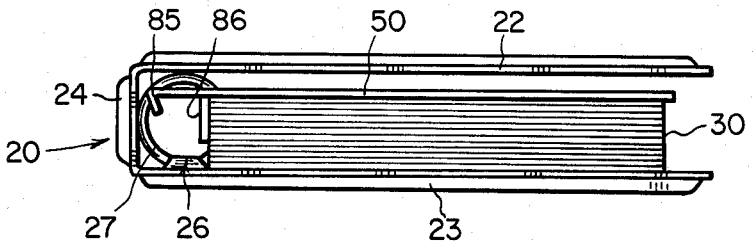
FIG. 10 illustrates the lectern according to FIG. 9 in association with a ring binder.

As illustrated in FIG. 10, this lectern can be accommodated within the binder 20 in an exactly similar manner to that of the embodiment of FIG. 1.

In the embodiments described above, the channel is a rigid and integral part of the lectern, and is so designed as to be accommodated within a space available adjacent to the spine of the binder. However, it will be appreciated that it is normal for such binders to afford cover plates which are over-sized relative to the size of page for which the binder is intended. Accordingly, in many cases free space is available at the outer edge of the binder between the pages and the outer edges of the cover plates, and it would be within the concept of the invention to arrange a lectern within such a binder in such a way that channel portion is accommodated in such space. In this case, the edge of the lectern remote from the channel portion may conveniently be provided with apertures through which the rings of the binder may be passed in order to secure the lectern in position, when not required for use, for storage, transport, or the like.

Figure 11:
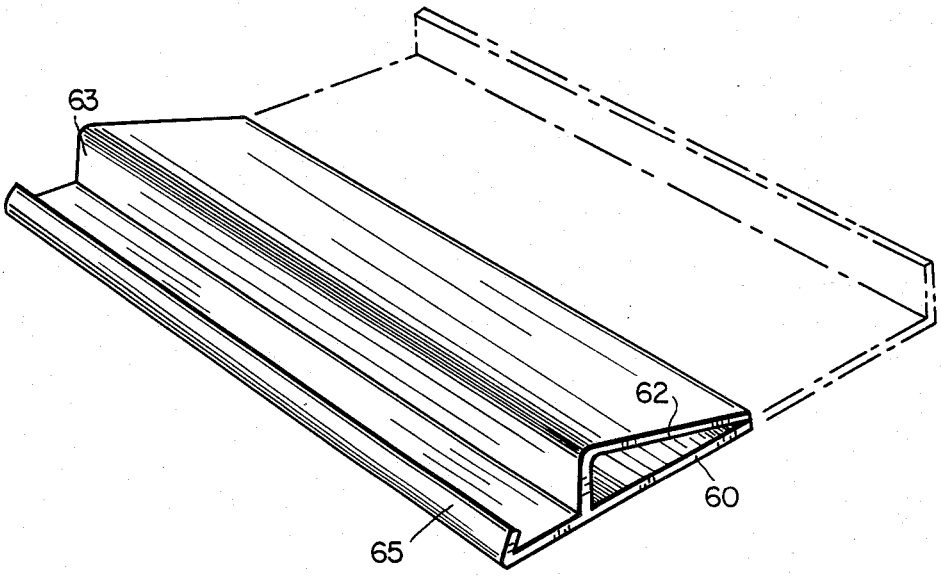
FIG. 11 illustrates a still further embodiment of a lectern base in accordance with the invention.
Figure 12:
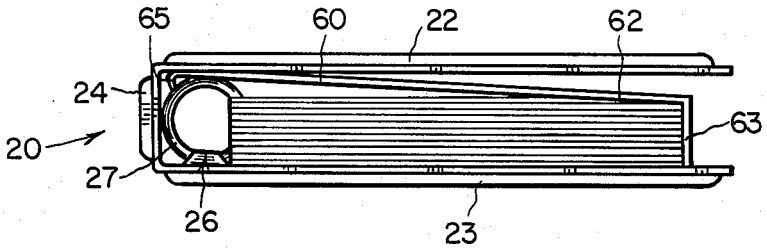
FIG. 12 illustrates the lectern base of FIG. 11 in accordance with a ring binder.

A further embodiment of the invention is illustrated in FIG. 11. This lectern utilizes available space at the outer edge of the binder, as illustrated in FIG. 12. In this case, the lectern comprises a generally flat plate 60 having an upturned lip 65 at one edge, and a further plate 62 which is foldably connected with the plate 60 along the edge opposed to the lip 65. The plate 62 includes a transverse flange 63 at its free edge. The arrangement is such that in a storage position the plates 60 and 62 are disposed in co-planar relation so that the lectern can be stored within the ring binder 20 with the lip 65 engaged over the rings 27 of the binder mechanism 26 adjacent to the spine 24, and with the flange 63 located within the available space between the outer edges of the cover plates 22 and 23. In use, the plate 62 is folded fowardly over the plate 60 so that the flange 63 engages the plate 60 at a position spaced rearwardly from the lip 65. In this way, the flange 63 is equivalent to the wall 13 of FIG. 1, and the lectern can be used in an exactly similar manner.

It will be appreciated that in the case of all the above described embodiments, the dimensions of the lectern can be selected so as to be commensurate with those of the pages of the loose leaf binder for which the lectern is intended, and in this way the lectern can be dimensioned specifically for association with particular sizes of binder. While $8\frac{1}{2} \times 11''$ paper has been given as an example, it will be appreciated that such lecterns can be dimensioned for use with binders for any standard or non-standard paper size.

While the invention is particularly concerned with the provision of a generally flat lectern which is capable of being assembled with a specific ring binder when not in use, it will be appreciate that lecterns as described above may also be used with loose leaf binders of other types, or indeed with conventionally bound books. Accordingly, the invention is not limited in its concept to the combination of a binder and a lectern, and the lecterns may be manufactured and sold separately for use with any suitable book or, for example, with a clipboard which carries reading matter.

Figure 13:
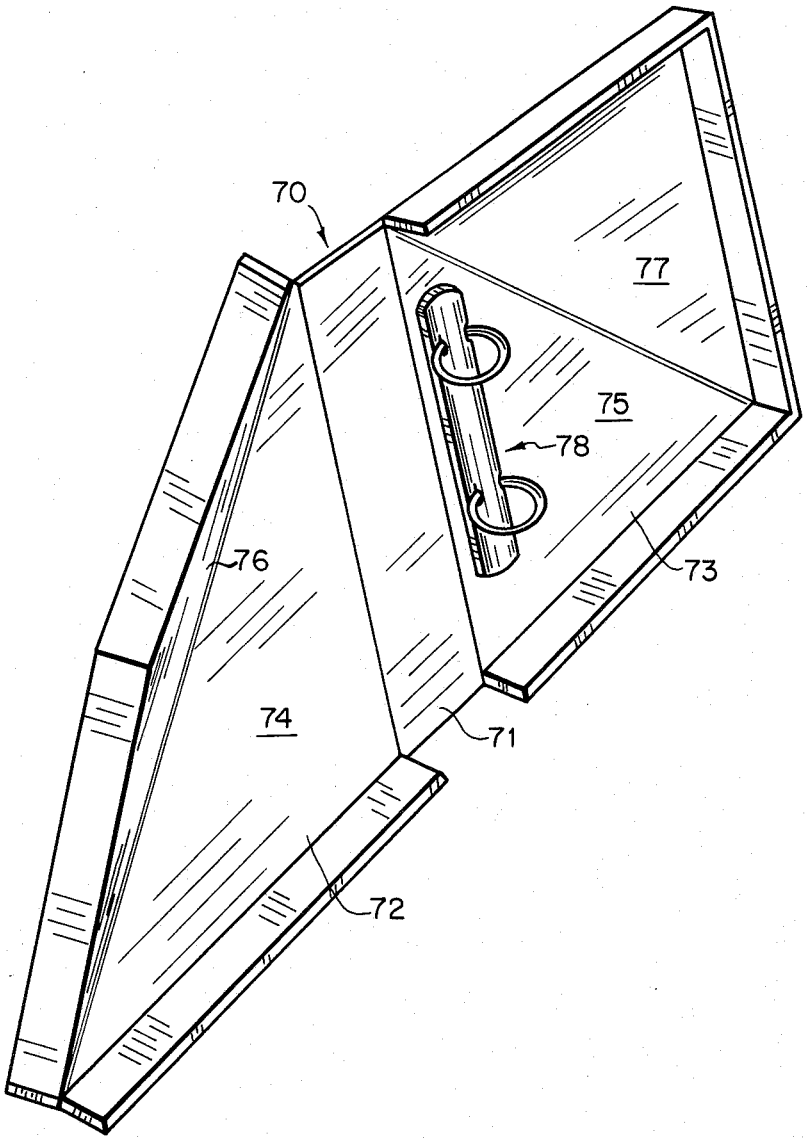
FIG. 13 illustrates a further embodiment of the invention in which a lectern base is incorporated into the cover of a ring binder.

In accordance with a further aspect of the invention, there is illustrated in FIG. 13, a further embodiment in which the cover of a binder is adapted to serve also as a lectern. As illustrated, the binder 70 comprises a cover having a conventional spine 71 with hingedly attached cover plates 72 and 73, the latter carrying a conventional ring binder mechanism 78. Each cover plate is diagonally divided into respective inner portions 74, 75 and outer portions 76, 77. Normally, the two portions are disposed in co-planar relationship so as to constitute an otherwise conventional cover plate, and a strap or other suitable means (not shown) may be provided to hold the cover plates in a closed position in spaced parallel relationship. As illustrated the cover plates may include upstanding side walls which in combination define a box to enclose and protect the contents of the binder.

When required for use, the outer portions 74, 75 are folded rearwardly about the diagonals so that the outer edges thereof (normally parallel to the spine 71) assume a horizontal position, co-planar with the lower edges of the inner portions 74, 75, which edges collectively define a generally triangular base whereby the open binder can be supported in a stable manner on a supporting surface with the spine 71 at the desired angle. The strap previously mentioned may be used to secure the folded outer portions 76, 77 together in this position, as well as in the closed position.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. A portable lectern comprising:

means for releaseably retaining a plurality of sheet members; and a separate base member configured and dimensioned for standing in a stable manner on a relatively flat surface, said base member comprising a generally planar section having front and back portions and which is inclined with respect to the flat surface so that the front portion does not contact the flat surface and means for supporting said sheet member retaining means in a predetermined position for viewing the sheet members to facilitate reading or lecturing therefrom, said supporting means attached to and extending generally perpendicularly along at least part of said front portion of said generally planar section;

said base member being configured and dimensioned to be selectively removable combinable with said sheet member retaining means to facilitate portability of same for transport and storage.

2. The lectern of claim 1 wherein the dimensions of said base member are equal to or less than the dimensions of said sheet member retaining means so that said base member may be assembled with said sheet member retaining means to form a compact unit.

3. The lectern of claim 2 wherein the channel portion has a rectangular U-shaped cross section which conforms to the bottom portion of said sheet member retaining means and which is configured to correspond to the predetermined angle of said sheet member retaining means.

4. The lectern of claim 2 wherein the channel portion is formed by folding the base member upon itself; the base member including a lip portion on a first side and a substantially perpendicular wall member on the opposite side; the dimensions and relative configurations of said lip portion, wall member, and first and second sides of said base member after folding being such as to support said retaining means at said predetermined viewing position.

5. The lectern of claim 1 wherein the support means comprises a channel portion for contacting a marginal portion of said sheet merber retaining means to maintain it at a predetermined orientation to facilitate viewing of the sheet members.

6. The lectern of claim 5 wherein the support means maintains said sheet member retaining means at a predetermined angle with respect to the flat surface.

7. The lectern of claim 1 wherein said sheet member retaining means is a clipboard.

8. The lectern of claim 1 wherein said sheet member retaining means is a ring binder.

9. A portable lectern comprising:

means for releaseably retaining a plurality of sheet members; and a separate base member configured and dimensioned for standing in a stable manner on a relatively flat surface, said base member comprising a generally planar section and a channel portion for contacting a marginal portion of said sheet member retaining means to retain said means at a predetermined orientation, said channel portion comprising a first side portion that is generally perpendicular to said generally planar section, a generally flat base portion extending thereupon for contact with a support surface, and a second side connected to said base portion for engagement with said sheet member retaining means when said retaining means is positioned on said channel portion first side, the dimensions and relative configurations of said first and said second sides being such as to support said retaining means at said predetermined position for viewing said sheet members.

10. The lectern of claim 4 wherein said channel portion extends substantially completely along one side of said generally planar section.

11. The lectern of claim 9 wherein the support means maintains said sheet member retaining means at a predetermined angle with respect to the flat surface.

12. A portable lectern comprising:

a binder having front and rear cover members connected by a spine portion at least one of which includes means for releaseably retaining a plurality of sheet members of paper between the cover members; and a base member configured and dimensioned for free standing in a stable manner on a support surface, said base member comprising at least one generally planar section and channel means for contacting a marginal portion of said binder to maintain it at a predetermined angle with respect to the support surface to facilitate viewing of said sheet members;

said channel means being located on one side of said generally planar section; and said base member being configured and dimensioned to be selectively removably combinable with said binder and having dimensions which are not larger than the dimensions of the binder to facilitate the portability of the lectern for transport and storage as a compact unit.

13. The lectern of claim 12 wherein at least one of the binder or base member further comprises pocket means for holding articles.

14. The lectern of claim 13 wherein the articles are at least one of floppy discs, loose sheet members, or cassette tapes.

15. The lectern of claim 12 wherein the retaining means comprises at least two ring means.

16. The lectern of claim 15 wherein said base member further comprises a number of elongated slots which correspond to the number of ring means of said retaining means for nestling engagement of said base member therewith.

17. A portable lectern comprising:

a loose leaf binder having front and rear cover members connected by a spine, at least one of which includes means for releaseably retaining leaves of sheet members between the cover members; and a base member comprising a planar section having transverse dimensions not greater than those of the cover member and channel means located on one side of the planar section for reception of a marginal portion of at least one of said binder cover members or spine to maintain said binder at a predetermined orientation to facilitate viewing of said sheet members;

said channel means being of a depth which is much less than the transverse dimensions of the binder such that the base member may be assembled within said binder for transport and storage as a compact unit.

18. The lectern of claim 17 wherein the retaining means comprises ring means.

19. The lectern of claim 18 wherein said channel means is formed as a rigid, integral extension of the planar section of said base member, and further comprises apertures adapted to receptively accommodate the ring means when said base member is assembled within said binder.

20. The lectern of claim 19 wherein said apertures are configured and dimensioned in the form of elongated slots.

21. The lectern of claim 17 wherein each of the remaining three sides of said planar section of said base member includes a wall member extending perpendicular thereto so as to form a tray for articles.

22. The lectern of claim 17 wherein said channel means maintains said binder at a predetermined angle with respect to a relatively flat support surface.

* * * * *